US012385277B2

(12) United States Patent
Zhao et al.

(10) Patent No.: US 12,385,277 B2
(45) Date of Patent: Aug. 12, 2025

(54) HIGH-RISE MODULAR STEEL STRUCTURE BUILDING NODE IN REGION OF HIGH SEISMIC INTENSITY AND CONSTRUCTING METHOD THEREFOR

(71) Applicant: SOUTH CHINA UNIVERSITY OF TECHNOLOGY, Guangzhou (CN)

(72) Inventors: Junxian Zhao, Guangzhou (CN); Zhiqiu He, Guangzhou (CN); Qixiang Tian, Guangzhou (CN); Wei Han, Guangzhou (CN)

(73) Assignee: SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 0 days.

(21) Appl. No.: 18/037,777

(22) PCT Filed: Oct. 31, 2022

(86) PCT No.: PCT/CN2022/128829
§ 371 (c)(1),
(2) Date: May 19, 2023

(87) PCT Pub. No.: WO2024/021345
PCT Pub. Date: Feb. 1, 2024

(65) Prior Publication Data

US 2024/0368911 A1 Nov. 7, 2024

(30) Foreign Application Priority Data

Jul. 27, 2022 (CN) ..... 202210895912.4

(51) Int. Cl.
*E04H 9/02* (2006.01)
*E04B 1/38* (2006.01)
(Continued)

(52) U.S. Cl.
CPC ..... *E04H 9/024* (2013.01); *E04B 1/38* (2013.01); *E04B 1/58* (2013.01); *E04B 1/98* (2013.01); *E04H 9/02* (2013.01); *E04H 9/021* (2013.01)

(58) Field of Classification Search
CPC ..... E04H 9/024; E04H 9/021; E04H 9/02; E04B 1/343; E04B 1/348; E04B 1/38; E04B 1/58; E04B 1/98; E04G 21/14
See application file for complete search history.

(56) References Cited

U.S. PATENT DOCUMENTS

2024/0368911 A1* 11/2024 Zhao ..... E04G 21/14

FOREIGN PATENT DOCUMENTS

CN 203834666 U * 9/2014
CN 109322390 2/2019
(Continued)

OTHER PUBLICATIONS

"International Search Report (Form PCT/ISA/210) of PCT/CN2022/128829," mailed on Feb. 22, 2023, pp. 1-4.

*Primary Examiner* — Andrew J Triggs
(74) *Attorney, Agent, or Firm* — JCIPRNET

(57) ABSTRACT

The building node includes an upper unit column, a lower unit column, an upper unit bottom beam, a lower unit ceiling beam, an upper connecting box, a lower connecting box, a connecting plate, an upper anchorage device, a lower anchorage device, an upper sleeve, a lower sleeve, a pull rod shear lock, position limiting nuts, and an injection pipe. The lower anchorage device is fixedly connected to the top plate of the lower connecting box; the lower position limiting nut is fixedly connected to the lower anchorage device; one end of the lower sleeve is fixedly connected to the lower anchorage device, and another end of the lower sleeve is fixedly connected to the top plate of the lower connecting box; the
(Continued)

bottom of the upper sleeve is fixedly connected to the bottom plate of the upper connecting box.

20 Claims, 4 Drawing Sheets

(51) Int. Cl.
*E04B 1/58* (2006.01)
*E04B 1/98* (2006.01)

(56) References Cited

FOREIGN PATENT DOCUMENTS

| | | | | | |
|---|---|---|---|---|---|
| CN | 209211624 U | * | 8/2019 | ..... | E04B 1/2403 |
| CN | 112095784 | | 12/2020 | | |
| CN | 112095786 | | 12/2020 | | |
| CN | 213143413 | | 5/2021 | | |
| CN | 113374079 | | 9/2021 | | |
| CN | 115126096 | | 9/2022 | | |
| JP | 2020101048 | | 7/2020 | | |

* cited by examiner

A—A

HIGH-RISE MODULAR STEEL STRUCTURE BUILDING NODE IN REGION OF HIGH SEISMIC INTENSITY AND CONSTRUCTING METHOD THEREFOR

CROSS-REFERENCE TO RELATED APPLICATION

This application is a 371 application of the international PCT application serial no. PCT/CN2022/128829, filed on Oct. 31, 2022, which claims the priority benefit of China application no. 202210895912.4, filed on Jul. 27, 2022. The entirety of each of the above-mentioned patent applications is hereby incorporated by reference herein and made a part of this specification.

TECHNICAL FIELD

The present invention relates to the field of seismic resistance in building structures. And the present invention specifically relates to a high-rise modular steel structure building node applicable for a region of high seismic intensity and a constructing method therefor, in a modular steel structure building.

DESCRIPTION OF RELATED ART

As a highly integrated prefabricated building, modular steel structure building plays an important role in epidemic prevention and control, disaster prevention and emergency response and other fields. This type of building has the advantage of high integration, thereby making the construction of the connection between modules to be a major part of on-site construction. Therefore, targeted design is needed for the connections between modules for different building categories.

Currently, modular buildings are mainly used in temporary or permanent low-rise buildings. However, since the modular buildings have the advantage of high integration, their on-site construction speed is far higher than that of general prefabricated building, and this feature perfectly matches the characteristics of high turnover in the current construction industry, so the modular buildings gradually develop into high-rise permanent buildings. In addition, modular buildings have a high degree of standardization, and therefore they are very suitable for being used as permanent buildings for high-rise residential buildings, high-rise apartments, and hotels.

In addition, China has completely abolished non seismic regions, and more than half of the regions are located in high seismic intensity region of 7 degrees or above, which poses new challenges for modular steel structure buildings built in high seismic intensity regions. The existing modular steel structure buildings aimed at the application of low rise permanent buildings only require the axial force transmission of the vertical pressure bearing column for the connection between modules, and the shear force transmission of the horizontal friction holding columns to be maintained through horizontal friction connected between modules. When existing modular steel structure buildings are applied to high-rise buildings in high seismic intensity region, the following problems will occur:

(1) Lack of reliable lateral restraint mechanism between upper and lower module units:

Currently, the on-site connection of modular steel structure buildings mostly adopts dry operation to ensure the construction speed, and the shear bearing capacity between modules is provided through mutual lateral constraints at the connections between modules. Currently, there are currently two main lateral constraint mechanisms: 1) Utilizing the friction between the upper and lower module units to provide lateral constraint: the principle of this mechanism is to rely on the local coupling of axial force and shear-resistant capacity, that is, relying on the positive pressure at the interface between the upper and lower module units provided by axial force, so as to provide lateral friction. However, for high-rise modular steel structures built in the region of high seismic intensity, there will be significant drawing forces on the side columns and corner columns of the bottom floors located on the periphery of the building under earthquake action, significantly reducing the positive pressure at the interface of the modules, thereby weakening lateral constraints, leading to insufficient lateral constraints and shear-resistant capacity between the upper and lower modules. 2) Mechanical locking is provided between upper and lower module units using shear-resistant keys such as bolts and pins: the principle of this mechanism is to provide high-strength lateral restraint by utilizing the mechanical locking effect of shear-resistant keys such as bolts and pins. However, a certain mounting clearance (about 5 mm) needs to be left around the shear keys between modules to facilitate on-site installation between modules, This type of mounting clearance will only allow the shear-resistant key to resist shear after a certain degree of horizontal sliding between the upper and lower units, leading to a significant weakening of the overall and lateral rigidity of high-rise modular steel structure buildings built in the region of high seismic intensity, increasing the amplification effect of lateral displacement and dynamic load, and even leading to lateral shear bearing failure of the nodes.

(2) Lack of tensile overload protection mechanism between the upper and lower module units:

As mentioned above, more than half of China's regions are located in the regions of high seismic intensity of 7 degrees or above, and earthquakes have strong uncertainty. Once the connection between the upper and lower units experiences tensile yielding and residual deformation in the tensile direction under a super large earthquake that exceeds the design expectation, resulting in the inability to form secondary tensile rigidity and secondary tensile bearing capacity after the connection between modules is compressed and closed, a significant risk will be posed to the seismic safety of modular buildings in the regions of high seismic intensity.

(3) Lack of cost-effective assembly connection mechanism between the upper and lower module units:

As mentioned above, one of the driving forces behind the development of modular steel structure buildings towards high-rise buildings is their advantage of high integration and fast on-site construction speed, which enables the high cost of module production to be compensated for by the low construction cost of rapid assembly and rapid turnover on site. The connections between modules currently developed for temporary buildings or permanent low rise buildings generally include wet work connections and dry work connections.

Large scale wet work on site (concrete pouring) will significantly slow down the construction speed, which fail to achieve fast and efficient assembly on site and also fail to leverage the significant advantages of dry work of steel structures. At present, the main types of dry work connections include mechanical self-locking connections, connection of pre-stressed reinforcement through full building, bolted connection, and welding seam connection, wherein:

1) Mechanical self-locking connections involve a large number of complex and precise mechanical processes. Although on-site connections are efficient, the cost for connection is too high;
2) Connection of pre-stressed reinforcement through full building requires the arrangement of locks along the height and full length of the building, and sleeve splicing for the locks is required on site, which puts high requirements on construction accuracy and to some extent affects the efficiency of on-site construction. Moreover, the arrangement of locks along the full length also significantly increases the cost for connection;
3) Bolted connections require connections to be made outside the module box or in a completely enclosed space between the boxes. Therefore, local cutting of maintenance walls, floor slab or floors is required to reserve the construction space required for on-site connections. After construction, local backfilling to the cutting portions is carried out, making it difficult to achieve standardization of building components and rapid on-site assembly;
4) The welding seam connection needs to be completed on site, but it is difficult guarantee the quality of on-site welding, and the welding seam needs to be inspected after welding, which significantly affects the efficiency of the overall modular building construction speed. Obviously, the existing modular steel structure buildings cannot meet the usage needs.

Technical Solution

In order to overcome the problem in the prior art, the present invention provides a high-rise modular steel structure building node applicable for a region of high seismic intensity, which can achieve rapid assembly between the upper module and the lower module indoors. When the modular steel structure building is subjected to is subjected to disasters such as strong earthquakes or hurricanes, the anchorage devices, the sleeves, and the pull rod shear locks inside the connection node can efficiently transmit horizontal and vertical loads; when the using of the building is ended, rapid recycling of module units can be achieved through simple disassembly of the connection node.

In order to achieve the purpose of the present invention, the present invention provides a high-rise modular steel structure building node applicable for a region of high seismic intensity, and the high-rise modular steel structure building node is used for connecting the upper module unit and the lower module unit. The high-rise modular steel structure building node comprises an upper unit column, a lower unit column, an upper unit bottom beam, a lower unit ceiling beam, a upper connecting box, a lower connecting box, a connecting plate, an upper anchorage device, a lower anchorage device, an upper sleeve, an lower sleeve, an pull rod shear lock, position limiting nuts, and an injection pipe.

The upper unit column, the upper connecting box, the connecting plate, the lower connecting box, and the lower unit column are arranged sequentially from top to bottom. One end of the upper unit bottom beam is fixedly connected to a side wall of the upper connecting box, and one end of the lower unit ceiling beam is fixedly connected to a side wall of the lower connecting box. Specifically, the bottom end of the upper unit column is fixedly connected to the top plate of the upper connecting box. One end of the upper unit bottom beam is fixedly connected to the side plate of the upper connecting box, and the top end of the lower unit column is fixedly connected to the bottom plate of the lower connecting box. The upper connecting box is located above the lower connecting box, and the connecting plate is clamped between the upper connecting box and the lower connecting box.

The upper anchorage device is provided on an upper part of the upper connecting box and located inside the upper unit column. A bottom end of the lower anchorage device is fixedly connected to a top plate of the lower connecting box and a top end of the upper anchorage device is fixedly connected to a bottom surface of a top plate of the upper connecting box.

The upper anchorage device, the top plate and the bottom plate of the upper connecting box, the connecting plate, the top plate of the lower connecting box, and the lower anchorage device are provided with a positioning hole respectively, and all of the positioning holes are located on a same vertical line.

An upper position limiting nut is fixedly provided on both sides of a top plate of the upper anchorage device. A lower position limiting nut is fixedly provided on a bottom surface of the lower anchorage device. A bottom of the upper sleeve is fixedly connected to the bottom plate of the upper connecting box, and a bottom of the lower sleeve is fixedly connected to an inner top surface of the lower anchorage device and a top end of the lower sleeve is fixedly connected to the top plate of the lower connecting box.

The pull rod shear lock comprises an upper connecting section, a first transition section, a tension control section, a second transition section, and a shear control section. An end of the upper connecting section is provided with an upper thread and an end of the shear control section is provided with a lower thread. The pull rod shear lock sequentially passes through the positioning hole on the upper anchorage device; the positioning holes on the top plate and the bottom plate of the upper connecting box, the upper sleeve; the positioning hole on the connecting plate, and the positioning hole on the top plate of the lower connecting box; the lower sleeve and the positioning hole on the lower anchorage device, and the upper thread is threadedly connected to the upper position limiting nut, and the lower thread is threadedly connected to the lower position limiting nut fixed on the lower anchorage device; wherein the top end of the pull rod shear lock passes through the upper anchorage device and the top plate of the upper anchorage device is clamped between the two position limiting nuts, such that the axial pressure of the upper unit column may be transmitted to the pull rod shear lock through the upper anchorage device. The bottom surface of the lower anchorage device is welded to the position limiting nut on the lower anchorage device, such that the axial pressure transmitted by the upper unit column to the pull rod shear lock may be transmitted to the lower anchorage device and the lower unit column, thereby achieving self resetting of the node under the self weight of the structure in the presence of residual deformation under tension.

The mounting clearances are provided between the shear control section of the pull rod shear lock and the upper sleeve, between the shear control section of the pull rod shear lock and the positioning hole on the bottom plate of the upper connecting box, between the shear control section of the pull rod shear lock and the positioning hole on the connecting plate, between the shear control section of the pull rod shear lock and the positioning hole on the top plate of the lower connecting box, and between the shear control section of the pull rod shear lock and the lower sleeve, and the injection pipe is used for injecting the epoxy resin adhesive into the mounting clearances.

Furthermore, a pretightening force is applied to the pull rod shear lock through the upper position limiting nut.

Furthermore, a mounting clearance is provided between an upper part of the pull rod shear lock and an inner wall of the positioning hole in the upper connecting box.

Furthermore, a diameter of the tension control section in the pull rod shear lock is smaller than a diameter of the shear control section. The tension control section is weakened compared to the shear control section and the connecting section, the tensile damage area of the pull rod shear lock may be controlled by such design, which is conducive to achieving tensile overload protection of the node.

Furthermore, an operation window is respectively provided on a side plate of the upper unit column and a side of the upper anchorage device opposite to the side plate. That the local arrangement of walls and floors is changed on site to meet the structural assembly requirements may be avoided by such design, and thus improving assembly efficiency.

Furthermore, a column reinforcement plate is provided on the side plate of the upper unit column and located on a periphery of the operation window, and the column reinforcement plate is fixedly connected with an outer wall of the upper unit column.

Furthermore, the high-rise modular steel structure building node further comprises a reinforcing rib, and the reinforcing rib is provided inside the upper unit column and above the operation window, and the reinforcing rib is fixedly connected with the inner wall of the upper unit column.

Furthermore, an injection hole is provided on a side plate of the lower connecting box. One end of the injection pipe is communicated with the injection hole, and another end of the injection pipe passes through the side plate of the lower connecting box, the lower anchorage device, and the lower sleeve sequentially, and is fixed on the lower sleeve. Such design aims to facilitate injection operations and to improve the efficiency of assembly of the node. The epoxy resin adhesive is injected, through the injection pipe, into the mounting clearances provided between the shear control section of the pull rod shear lock and the upper sleeve, between the shear control section of the pull rod shear lock and the positioning hole in the bottom plate of the upper connecting box, between the shear control section of the pull rod shear lock and the positioning hole in the connecting plate, between the shear control section of the pull rod shear lock and the positioning hole in the top plate of the lower connecting box, and between the shear control section of the pull rod shear lock and the lower sleeve. The epoxy resin adhesive can be injected into the mounting clearances and filled in the mounting clearances through the injection pipeline and through the injection hole. Such design aims to eliminate the mounting clearances.

Furthermore, a certain clearance is provided between the upper part of the pull rod shear lock and the positioning hole in the upper connecting box.

Furthermore, the upper unit column is welded to the top plate of the upper connecting box, and the bottom end of the upper anchorage device is welded to the bottom plate of the upper connecting box. One end of the upper unit bottom beam is welded to a side plate of the upper connecting box. A bottom of the upper sleeve is welded to the bottom plate of the upper connecting box. A top end of the lower anchorage device is welded to the top plate of the lower connecting box, and the bottom surface of the lower anchorage device is welded to the position limiting nut on the lower anchorage device. An upper end of the lower sleeve is welded to the top plate of the lower connecting box, and a lower end of the lower sleeve is welded to a bottom plate of the lower anchorage device. A top end of the lower unit column is welded to a bottom surface of the lower connecting box, and one end of the lower unit ceiling beam is welded to the side plate of the lower connecting box.

A construction method for the high-rise modular steel structure building node applicable for the region of high seismic intensity provided by the present invention comprises the following steps of:

(1) reserving the positioning holes in the top plate and the bottom plate of the upper connecting box, connecting plate, the top plate of the bottom connecting box, the upper anchorage device, and the lower anchorage device in a factory (2) in the factory, fixedly connecting the lower anchorage device to the lower sleeve, reserving the injection pipe hole, mounting the injection pipe, and providing a lower position limiting nut at a lower part of the lower anchorage device, fixedly connecting the lower position limiting nut to the lower anchorage device; fixedly connecting the upper sleeve to the bottom plate of the upper connecting box;

(3) in the factory, fixedly connecting the lower anchorage device to a bottom surface of the top plate of the lower connecting box, and fixedly connecting the upper anchorage device to the top surface of the upper connecting box;

(4) in the factory, connecting the bottom plate, the top plate, a front plate, and a rear plate of the upper connecting box to a left side plate and a right side plate of the upper connecting box by welding and connecting the bottom plate, the top plate, a front plate, and a rear plate of the lower connecting box to a left side plate and a right side plate of the lower connecting box by welding, such that the upper connecting box and the lower connecting box are formed respectively;

(5) After hoisting of the lower unit is completed at a construction site, placing the connecting plate reserved with the positioning hole above the top plate of the lower connecting box, and aligning a center of the positioning hole in the connecting plate with a center of the positioning hole in the top plate of the lower connecting box vertically;

(6) Passing the pull rod shear lock through the connecting plate, the top plate of the lower connecting box, the lower sleeve, and the lower anchorage device from top to bottom sequentially, and threadedly and fixedly connecting the pull rod shear lock to the lower position limiting nut located on the bottom surface of the lower anchorage device;

(7) hoisting and placing the upper unit onto the lower unit, and at this time, the pull rod shear lock passing through the bottom plate of the upper connecting box and the top plate of the upper connecting box sequentially.

(8) suspending hoisting when a top end of the pull rod shear lock passes through the top plate of the upper connecting box and does not pass through the upper anchorage device, and starting hoisting again after screwing on the upper position limiting nut located at the lower part of the upper anchorage device;

(9) tightening the upper position limiting nut located at the lower part of the upper anchorage device and applying pretightening force through the position limiting nut, after the top of the pull rod shear lock passes through the upper anchorage device and the hoisting operation is completed;

(10) After applying pretightening force, injecting epoxy resin adhesive into the mounting clearance around the shear control section of the pull rod shear lock through the injection pipe, such that installation of the high-rise modular steel structure building node is completed.

Furthermore, the above method further includes the following comprises:

Injecting the epoxy resin adhesive, through the injection pipe, into the clearances between the shear control section of the pull rod shear lock and the upper sleeve, between the shear control section of the pull rod shear lock and the positioning hole in the bottom plate of the upper connecting box, between the shear control section of the pull rod shear lock and the positioning hole in the connecting plate, between the shear control section of the pull rod shear lock and the positioning holes in the top plate of the lower connecting box, and between the shear control section of the pull rod shear lock and the lower sleeve.

Beneficial Effect

Compared with the prior art, the beneficial effects of the present invention lie in:

The present invention provides a modular steel structure building connection node to solve the key problems faced by such buildings in the regions of high seismic intensity and high-rise building scenarios, such as insufficient shear-resistant capacity, inability for secondary tensile bearing after overload, high cost for connection between modules, and low construction efficiency. The building node provided by the application has the following functions:

1) Provide reliable lateral restraint for the upper and lower module units:

As shown in FIG. 1, by arranging the pull rod shear lock as the shear-resistant key, relying on the locking effect of this component to provide high-strength lateral restraint, the epoxy resin adhesive is injected through the injection pipe into the clearance in the shear bearing area of pull rod shear lock (shear-resistant key), thereby eliminating the mounting clearance, eliminating the horizontal sliding of the module under earthquake, which meets the high bearing capacity and high rigidity requirements of the connection between module units.

2) Provide tensile overload protection for upper and lower module units:

As shown in FIG. 1, the transmission of axial tension between the upper unit and the lower unit can be achieved by arranging the pull rod shear lock that connects the upper unit column and the lower unit column. By weakening the tension control section of the pull rod shear lock relatively (the diameter of the tension control section is smaller than the diameter of the shear control end) (as shown in FIG. 4), the tensile damage of the nodes can be controlled within this area when the connection between the upper and lower units is under an earthquake that exceeds the design expectation, thereby achieving tensile overload protection of the nodes, and the two ends of the pull rod shear lock are fixedly connected between the upper and lower module units without separation, so that the node can achieve self resetting through reverse compression of self weight of the structure after yielding in tension, and form secondary tensile rigidity and secondary tensile bearing capacity.

3) Provide an economical and efficient assembly connection mechanism

The modules are only connected through locally provided pull rod shear locks without the need for an arrangement of locks along the full length, greatly saving connection costs. On site, only the pull rod shear locks need to be tensioned without wet work or welding work. The connection part is located in the area inside the box where no walls or floors are provided. By reserving operation holes in the column walls with operating space, the economical and efficient assembly connection on site is achieved.

DESCRIPTION OF THE EMBODIMENTS

In order to make the purpose, technical solution, and advantages of the present invention clearer, a further detailed explanation of the present invention will be provided in the followings, in conjunction with the accompanying drawings and embodiments. It should be understood that the specific embodiments described here are only intended to explain the present invention and are not intended to limit it.

In the description of the present invention, it should be noted that the orientation or position relationship indicated by the terms "center", "up", "bottom", "left", "right", "vertical", "horizontal", "inside", "outside", etc., are based on the orientation or position relationship shown in the accompanying drawings. And the terms are only for the convenience of describing the present invention and simplifying the description, rather than indicating or implying that the device or element referred to must have a specific orientation or must be constructed and operated in a specific orientation, and therefore the terms cannot be understood as a limitation of the present invention. In addition, unless otherwise specified and limited, the terms "installation", "connection", and "connecting" should be understood broadly, for example, it can be fixed connection, detachable connection, or integrated connection; it can be directly connected, or indirectly connected through an intermediate medium, or it can be the internal communication between two components. For an ordinary skilled person in the art, the specific meanings of the above terms in the present invention can be understood based on specific circumstances.

Figure 1:
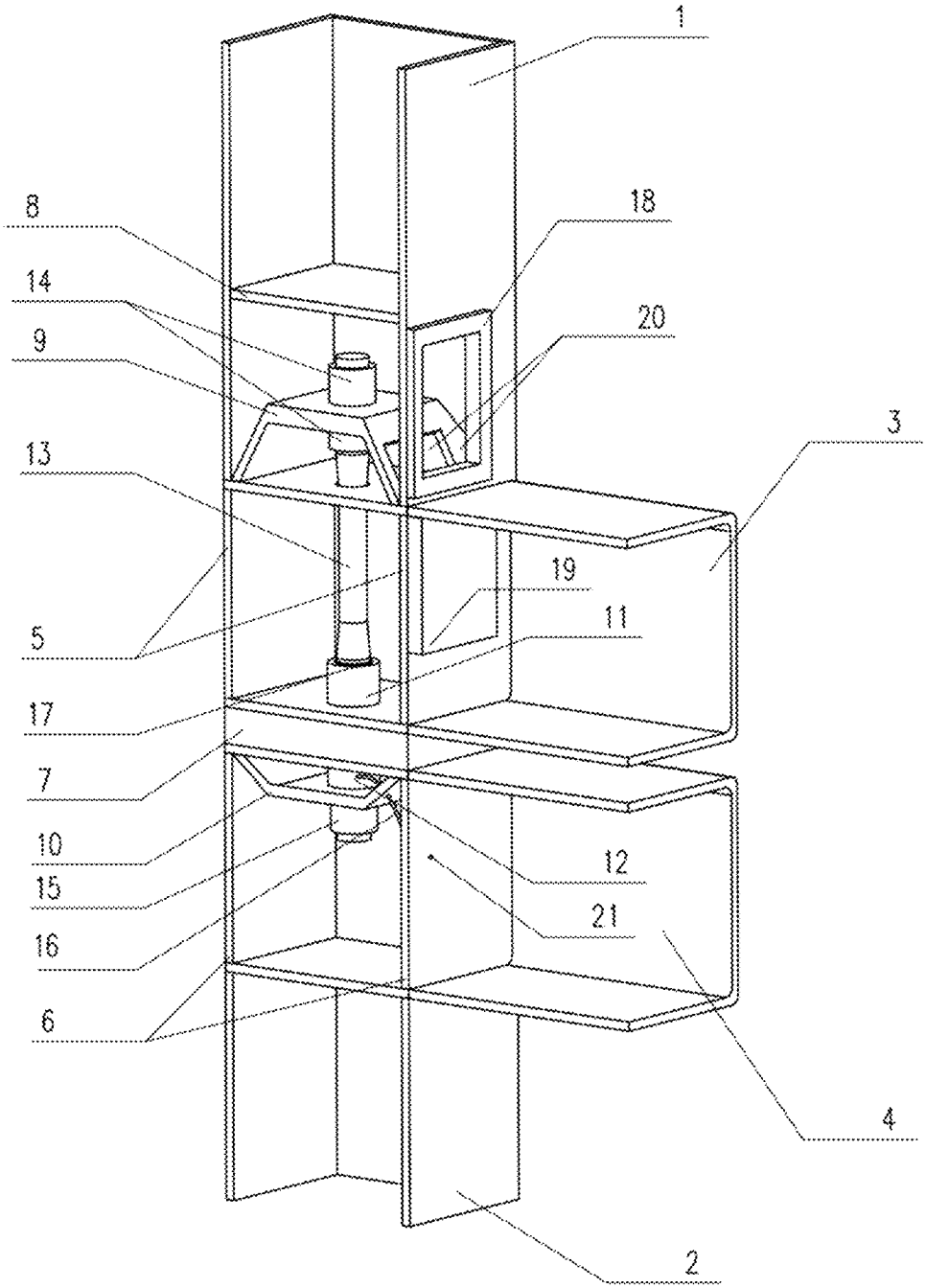
FIG. 1 is a structural schematic and perspective view of the connection node when used for a corner column in the embodiment of the present invention.
Figure 2:
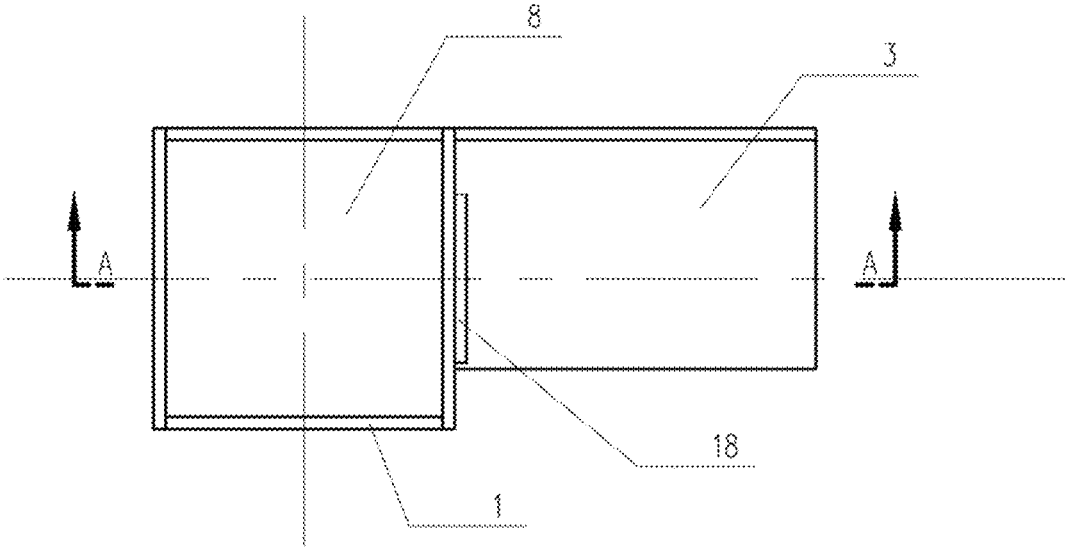
FIG. 2 is a top view of the connection nodes shown in FIG. 1.
Figure 3:
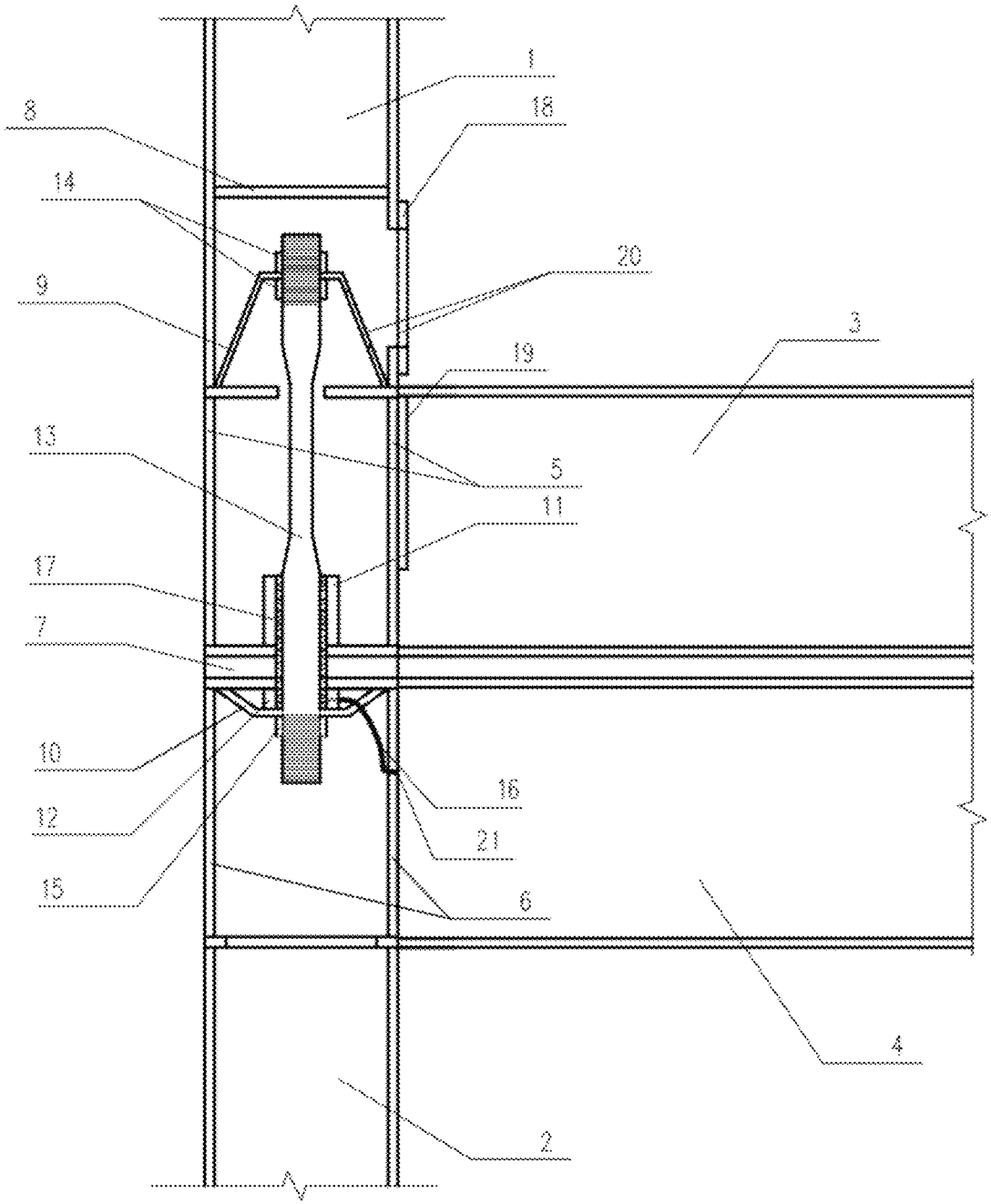
FIG. 3 is a cross-sectional schematic view of the connection nodes shown in FIG. 2 along the section A-A.

FIGS. 1, 2, and 3 illustrate a high-rise modular steel structure building node applicable for a region of high seismic intensity provided by the present invention, which comprises an upper unit column 1, a lower unit column 2, an upper unit bottom beam 3, a lower unit ceiling beam 4, an upper connecting box 5, a lower connecting box 6, a connecting plate 7, a reinforcement rib 8, an upper anchorage device 9, a lower anchorage device 10, an upper sleeve 11, a lower sleeve 12, a pull rod shear lock 13, an upper position limiting nut 14, a lower position limiting nut 15, an injection pipe 16, an epoxy resin adhesive 17, a column reinforcement plate 18, a beam reinforcement plate 19, an operation window 20, and an injection hole 21.

The upper unit column 1 is welded to the top plate of the upper connecting box 5, and the bottom end of the upper anchorage device 9 is welded to the top plate of the upper connecting box 5. One end of the upper unit bottom beam 3 is welded to the side plate of the upper connecting box 5. The top end of the lower anchorage device 10 is welded to the top plate of the lower connecting box 6, and the bottom surface of the lower anchorage device 10 is welded to the lower position limiting nut 15. The upper end of the lower sleeve 12 is welded to the top plate of the lower connecting box 6, and the lower end of the lower sleeve 12 is welded to the bottom plate of the lower anchorage device 10. The bottom of the upper sleeve 11 is welded to the bottom plate of the upper connecting box 5. The top end of the lower unit column 2 is welded to the bottom surface of the lower connecting box 6, and one end of lower unit ceiling beam 4 is welded to the side plate of lower connecting box 6.

The top plate and the bottom plate of the upper connecting box 5, the connecting plate 7, the top plate of lower connecting box 6, the upper anchorage device 9, and the lower anchorage device 10 are provided with a positioning hole respectively.

The upper connecting box 5 is located above the lower connecting box 6, and the connecting plate 7 is clamped between the upper connecting box 5 and the lower connecting box 6.

The pull rod shear lock 13 comprises an upper connecting section, a first transition section, a tension control section, a second transition section, and a shear control section. An end of the upper connecting section is provided with an upper thread and an end of the shear control section is provided with a lower thread. The tension control section is weakened relative to the shear control section and the connecting section. In some embodiments of the present invention, referring to FIG. 4, the diameter of the upper connecting section is the same to that of the shear control section. The diameter of the tension control section is smaller than that of the shear control section. The diameter of the first transition section connecting the upper connecting section and the tension control section, as well as, the diameter of the second transition section connecting the shear control section and the tension control section, gradually decreases. The pull rod shear lock 13 sequentially passes through the positioning hole on the upper anchorage device 9, the positioning holes on the top plate and the bottom plate of the upper connecting box 5, the upper sleeve 11, the positioning hole on the connecting plate 7, the positioning hole on the top plate of the lower connecting box 6, the lower sleeve 12, and the positioning hole on the lower anchorage device 10. The bottom end of the pull rod shear lock 13 passes through the lower anchorage device 10 and is connected to the lower position limiting nut 15 fixed to the lower anchorage device 10 through the lower thread.

The injection hole 21 is located on the side plate of the lower connecting box 6, and one end of the injection pipe 16 is connected to the injection hole 21. Another end of the injection pipe 16 passes through the side plate of the lower connecting box 6, the lower anchorage device 10, and the lower sleeve 12 sequentially, and then is fixed on the lower sleeve 12, which is communicated with the mounting clearance.

The upper anchorage device 9 is located on the upper part of the upper connecting box 5 and inside the upper unit column 2, and the bottom end of the upper anchorage device 9 is fixedly connected to the top plate of the upper connecting box 5. The top of the pull rod shear lock 13 passes through the upper anchorage device 9, and the upper position limiting nut 14 are respectively mounted on both sides of the top plate of the upper anchorage device 9. The upper part of the pull rod shear lock 13 is threadedly connected to the upper position limiting nut 14.

Furthermore, a certain mounting clearance is provided between the shear control section of the pull rod shear lock 13 and the upper sleeve 11, between the shear control section of the pull rod shear lock 13 and the positioning hole in the bottom plate of the upper connecting box 5, between the shear control section of the pull rod shear lock 13 and the positioning hole in the connecting plate 7, between the shear control section of the pull rod shear lock 13 and the positioning hole in the top plate of the lower connecting box 6, and between the shear control section of the pull rod shear lock 13 and the lower sleeve 12. A certain clearance is provided between the upper part of the pull rod shear lock 13 and the positioning hole inside the upper connecting box 5.

When the upper connecting box 5 is subjected to horizontal force, the locking effect of the pull rod shear lock 13 can be converted into the shear stress resistance of the pull rod shear lock 13.

When the upper unit column 1 is subjected to vertical tension, it can be transmitted to the lower unit column 2 through the upper anchorage device 9, pull rod shear lock 13, and lower anchorage device 10.

The side plate of the upper unit column 1 and the same side of the upper anchorage device 9 to the side plate are provided with operation windows 20 for workers to operate the upper position limiting nuts 14.

In some embodiments of the present invention, a column reinforcement plate 18 is arranged on the side plate of the upper unit column 1 and located on a periphery of the operation window. In other embodiments, flipped panels and decorative panels can also be mounted at the operation window of the upper unit column 1 after the installation of the building node is completed.

The building in the present embodiment is applicable for the connection between units and between units and foundations in building forms such as a high-rise modular steel structure building building node in the region of high seismic intensity and so on, and especially is applicable for in node areas where the axial force changes significantly under horizontal or vertical actions of corner columns and side columns.

In some embodiments of the present invention, an assembly method for the above-mentioned connection nodes is further provided, which comprises the following steps of:

(1) the positioning holes in the top plate and the bottom plate of upper connection box 5, connection plate 7, the top plate of the bottom connecting box 6, the upper anchorage device 9, and the lower anchorage device 10 is reserved in the factory to avoid collision with the pull rod shear lock 13;

(2) in the factory, the lower anchorage device 10 is fixedly connected to the lower sleeve 12, and the injection pipe hole is reserved and the injection pipe 16 is mounted; a lower position limiting nut 15 is provided at a lower part of the lower anchorage device 10, and the lower position limiting nut is welded to the lower anchorage device 10;

(3) in the factory, the lower anchorage device 10 is welded to the bottom surface of the top plate of the lower connection box 6, and the upper anchorage device 9 is welded to the top surface of the upper connection box 5, and the upper sleeve 11 is welded to the bottom plate of the upper connection box 5;

(4) in the factory, the bottom plate, the top plate, a front plate, and a rear plate of the upper connecting box 5 is connected to a left side plate and a right side plate of the upper connecting box 5 by welding and the bottom plate, the top plate, a front plate, and a rear plate of the lower connecting box 6 is connected to a left side plate and a right side plate of the lower connecting box 6 by welding, such that the upper connecting box 5 and the lower connecting box 6 are formed respectively;

(5) After hoisting of the lower unit is completed at a construction site, the connecting plate 7 reserved with the positioning hole is placed above the top plate of the lower connecting box 6, and a center of the positioning hole in the connecting plate 7 is vertically aligned with a center of the positioning hole in the top plate of the lower connecting box 6;

(6) the pull rod shear lock 13 is passed through the connecting plate 7, the top plate of the lower connecting box 6, and the lower anchorage device 10 from top to bottom sequentially, and is threadedly and fixedly connected to the lower position limiting nut 15 located on the bottom surface of the lower anchorage device 10;

(7) the upper unit is hoisted and placed onto the lower unit, and at this time, the pull rod shear lock 13 passes through the bottom plate of the upper connecting box 5 and the top plate of the upper connecting box 5 sequentially;

(8) hoisting is suspended when a top end of the pull rod shear lock 13 passes through the top plate of the upper connecting box 5 and does not pass through the upper anchorage device 9, and hoisting is started again after the upper position limiting nut 14 located at the lower part of the upper anchorage device 9 is screwed on;

(9) the upper position limiting nut 14 located at the lower part of the upper anchorage device is tightened and pretightening force is applied through the position limiting nut 14, after the top end of the pull rod shear lock 13 passes through the upper anchorage device 9 and the hoisting operation is completed.

(10) After applying pretightening force, an epoxy resin adhesive 17 is injected through the injection pipe into the mounting clearance around the shear control section of the pull rod shear lock 13, such that installation of the high-rise modular steel structure building node is completed.

Steps (1) to (4) are processed and assembled in the factory, and steps (5) to (10) are completed on the engineering project site.

Figure 4:
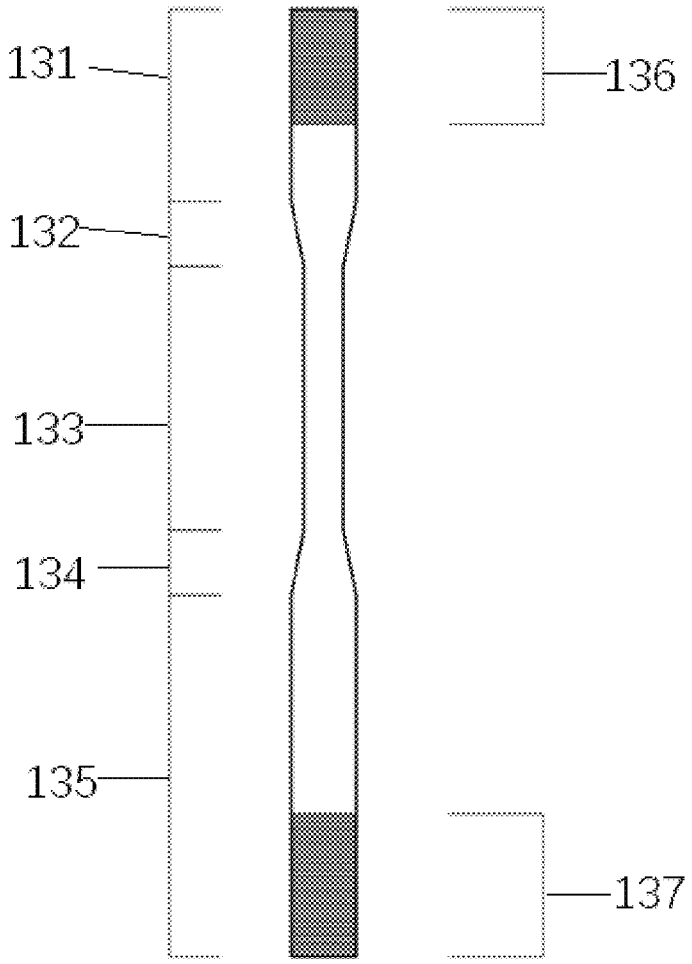
FIG. 4 is a schematic view of a pull rod shear lock.

Through the specific structure and construction method of the building nodes mentioned above, the building nodes provided by the embodiments of the present invention can meet the following advantages required in engineering projects:

1. Through reasonable design and reliable construction, it is possible to use the pull rod shear lock 13 as the shear-resistant key for the upper module unit and the lower module unit, and high-strength lateral restraint is provided by relying on the locking effect of this component; and the epoxy resin adhesive 17 is injected through the injection pipe 16 into the clearance in the shear bearing area of pull rod shear lock 13 (shear-resistant key), thereby eliminating the mounting clearance, eliminating the horizontal sliding of the module under earthquake, and providing resistant-lateral rigidity. At this point, reliable lateral constraints are provided for the upper and lower module units.
2. Through reasonable design and reliable construction, the transmission of axial tension between the upper unit and the lower unit can be achieved by arranging the pull rod shear lock 13 that connects the upper unit column and the lower unit column, and the tension control section of the pull rod shear lock 13 can be relatively weakened (as shown in FIG. 4) to achieve tensile overload protection of the node under tension.
3. Through reasonable design and reliable construction, complete use of bolted connections on site can be achieved effectively by designing the connection to be inside the column and reserving operating holes on the column, thereby avoiding punching holes in walls and floors or avoiding external works, and effectively avoiding large-scale wet works, ultimately achieving efficient and economical assembly on site.

Applying the node provided by the aforementioned embodiments in engineering projects can achieve rapid assembly between the upper module and the lower module indoors, without the need to reserve holes on the floor or beams; when the modular steel structure building is subjected to disasters such as strong earthquakes or hurricanes, the anchorage devices, the sleeves, and the pull rod shear lock inside the connection node can efficiently transmit horizontal and vertical loads; when the using of the building is ended, rapid recycling of module units can be achieved through simple disassembly of the connection node.

The above is only a preferred embodiment of the present invention and is not intended to limit the present invention. Any modifications, equivalent substitutions, and improvements made within the spirit and principles of the present invention shall be included in the scope of protection of the present invention.

What is claimed is:

1. A high-rise modular steel structure building node applicable for a region of high seismic intensity, comprising: an upper unit column, a lower unit column, an upper unit bottom beam, a lower unit ceiling beam, a upper connecting box, a lower connecting box, a connecting plate, an upper anchorage device, a lower anchorage device, an upper sleeve, an lower sleeve, an pull rod shear lock, position limiting nuts, and an injection pipe, wherein the upper unit column, the upper connecting box, the connecting plate, the lower connecting box, and the lower unit column are arranged sequentially from top to bottom, one end of the upper unit bottom beam is fixedly connected to a side wall of the upper connecting box, and one end of the lower unit ceiling beam is fixedly connected to a side wall of the lower connecting box;

the upper anchorage device is fixed on a top plate of the upper connecting box and located inside the upper unit column, and the lower anchorage device is fixed on a top plate of the lower connecting box;

the upper anchorage device, a top plate and a bottom plate of the upper connecting box, the connecting plate, a top plate of the lower connecting box, and the lower anchorage device are provided with a positioning hole respectively, and all of the positioning holes are located on a same vertical line, an upper position limiting nut is fixedly provided on both sides of a top plate of the upper anchorage device, a lower position limiting nut is fixedly provided on a bottom surface of the lower anchorage device, the upper sleeve is fixedly provided on the bottom plate of the upper connecting box, and the lower sleeve is fixedly provided between the top plate of the lower connecting box and the lower anchorage device;

the pull rod shear lock comprises an upper connecting section, a first transition section, a tension control section, a second transition section, and a shear control section, an end of the upper connecting section is provided with an upper thread and an end of the shear control section is provided with a lower thread, the pull rod shear lock sequentially passes through the positioning hole on the upper anchorage device, the positioning hole on the top plate and the bottom plate of the upper connecting box, the upper sleeve, the positioning hole on the connecting plate, and the positioning hole on the top plate of the lower connecting box, the lower sleeve and the positioning hole on the lower anchorage device, and the upper thread is threadedly connected to the upper position limiting nut, and the lower thread is threadedly connected to the lower position limiting nut;

a mounting clearance is respectively provided between the shear control section of the pull rod shear lock and the upper sleeve, between the shear control section of the pull rod shear lock and the positioning hole on the bottom plate of the upper connecting box, between the shear control section of the pull rod shear lock and the positioning hole on the connecting plate, between the shear control section of the pull rod shear lock and the positioning hole on the top plate of the lower connecting box, and between the shear control section of the pull rod shear lock and the lower sleeve, and the injection pipe is used for injecting epoxy resin adhesive into the mounting clearance.

2. The high-rise modular steel structure building node applicable for the region of high seismic intensity according to claim 1, wherein a pretightening force is applied to the pull rod shear lock through the upper position limiting nut.

3. The high-rise modular steel structure building node applicable for the region of high seismic intensity according to claim 2, wherein the upper unit column is welded to the top plate of the upper connecting box, and a bottom end of the upper anchorage device is welded to the bottom plate of the upper connecting box; one end of the upper unit bottom beam is welded to a side plate of the upper connecting box; a bottom of the upper sleeve is welded to the bottom plate of the upper connecting box; a top end of the lower anchorage device is welded to the top plate of the lower connecting box, and the bottom surface of the lower anchorage device is welded to a position limiting nut on the lower anchorage device; an upper end of the lower sleeve is welded to the top plate of the lower connecting box, and a lower end of the lower sleeve is welded to a bottom plate of the lower anchorage device; a top end of the lower unit column is welded to a bottom surface of the lower connecting box, and one end of the lower unit ceiling beam is welded to a side plate of the lower connecting box.

4. The high-rise modular steel structure building node applicable for the region of high seismic intensity according to claim 1, wherein a mounting clearance is provided between an upper part of the pull rod shear lock and an inner wall of a positioning hole in the upper connecting box.

5. The high-rise modular steel structure building node applicable for the region of high seismic intensity according to claim 4, wherein the upper unit column is welded to the top plate of the upper connecting box, and a bottom end of the upper anchorage device is welded to the bottom plate of the upper connecting box; one end of the upper unit bottom beam is welded to a side plate of the upper connecting box; a bottom of the upper sleeve is welded to the bottom plate of the upper connecting box; a top end of the lower anchorage device is welded to the top plate of the lower connecting box, and the bottom surface of the lower anchorage device is welded to a position limiting nut on the lower anchorage device; an upper end of the lower sleeve is welded to the top plate of the lower connecting box, and a lower end of the lower sleeve is welded to a bottom plate of the lower anchorage device; a top end of the lower unit column is welded to a bottom surface of the lower connecting box, and one end of the lower unit ceiling beam is welded to a side plate of the lower connecting box.

6. The high-rise modular steel structure building node applicable for the region of high seismic intensity according to claim 1, wherein a diameter of the pull control section in the pull rod shear lock is smaller than a diameter of the shear control section.

7. The high-rise modular steel structure building node applicable for the region of high seismic intensity according to claim 6, wherein the upper unit column is welded to the top plate of the upper connecting box, and a bottom end of the upper anchorage device is welded to the bottom plate of the upper connecting box; one end of the upper unit bottom beam is welded to a side plate of the upper connecting box; a bottom of the upper sleeve is welded to the bottom plate of the upper connecting box; a top end of the lower anchorage device is welded to the top plate of the lower connecting box, and the bottom surface of the lower anchorage device is welded to a position limiting nut on the lower anchorage device; an upper end of the lower sleeve is welded to the top plate of the lower connecting box, and a lower end of the lower sleeve is welded to a bottom plate of the lower anchorage device; a top end of the lower unit column is welded to a bottom surface of the lower connecting box, and one end of the lower unit ceiling beam is welded to a side plate of the lower connecting box.

8. The high-rise modular steel structure building node applicable for the region of high seismic intensity according to claim 1, wherein an operation window is provided on a side plate of the upper unit column and a side of the upper anchorage device opposite to the side plate.

9. The high-rise modular steel structure building node applicable for the region of high seismic intensity according to claim 8, wherein a column reinforcement plate is provided on the side plate of the upper unit column and located on a periphery of the operation window, and the column reinforcement plate is fixedly connected to an outer wall of the upper unit column.

10. The high-rise modular steel structure building node applicable for the region of high seismic intensity according to claim 9, wherein the upper unit column is welded to the top plate of the upper connecting box, and a bottom end of the upper anchorage device is welded to the bottom plate of the upper connecting box; one end of the upper unit bottom beam is welded to a side plate of the upper connecting box; a bottom of the upper sleeve is welded to the bottom plate of the upper connecting box; a top end of the lower anchorage device is welded to the top plate of the lower connecting box, and the bottom surface of the lower anchorage device is welded to a position limiting nut on the lower anchorage device; an upper end of the lower sleeve is welded to the top plate of the lower connecting box, and a lower end of the lower sleeve is welded to a bottom plate of the lower anchorage device; a top end of the lower unit column is welded to a bottom surface of the lower connecting box, and one end of the lower unit ceiling beam is welded to a side plate of the lower connecting box.

11. The high-rise modular steel structure building node applicable for the region of high seismic intensity according to claim 8, wherein the high-rise modular steel structure building node further comprises a reinforcing rib, and the reinforcing rib is provided inside the upper unit column and above the operation window.

12. The high-rise modular steel structure building node applicable for the region of high seismic intensity according to claim 11, wherein the upper unit column is welded to the top plate of the upper connecting box, and a bottom end of the upper anchorage device is welded to the bottom plate of the upper connecting box; one end of the upper unit bottom beam is welded to a side plate of the upper connecting box; a bottom of the upper sleeve is welded to the bottom plate of the upper connecting box; a top end of the lower anchorage device is welded to the top plate of the lower connecting box, and the bottom surface of the lower anchorage device is welded to a position limiting nut on the lower anchorage device; an upper end of the lower sleeve is welded to the top plate of the lower connecting box, and a lower end of the lower sleeve is welded to a bottom plate of the lower anchorage device; a top end of the lower unit column is welded to a bottom surface of the lower connecting box, and one end of the lower unit ceiling beam is welded to a side plate of the lower connecting box.

13. The high-rise modular steel structure building node applicable for the region of high seismic intensity according to claim 8, wherein the upper unit column is welded to the top plate of the upper connecting box, and a bottom end of the upper anchorage device is welded to the bottom plate of the upper connecting box; one end of the upper unit bottom beam is welded to a side plate of the upper connecting box; a bottom of the upper sleeve is welded to the bottom plate of the upper connecting box; a top end of the lower anchorage device is welded to the top plate of the lower connecting box, and the bottom surface of the lower anchorage device is welded to a position limiting nut on the lower anchorage device; an upper end of the lower sleeve is welded to the top plate of the lower connecting box, and a lower end of the lower sleeve is welded to a bottom plate of the lower anchorage device; a top end of the lower unit column is welded to a bottom surface of the lower connecting box, and one end of the lower unit ceiling beam is welded to a side plate of the lower connecting box.

14. The high-rise modular steel structure building node applicable for the region of high seismic intensity according to claim 1, wherein an injection hole is provided on a side plate of the lower connecting box, one end of the injection pipe is communicated with the injection hole, and another end of the injection pipe passes through the side plate of the lower connecting box, the lower anchorage device, and the lower sleeve sequentially, and is fixed on the lower sleeve.

15. The high-rise modular steel structure building node applicable for the region of high seismic intensity according to claim 14, wherein the upper unit column is welded to the top plate of the upper connecting box, and a bottom end of the upper anchorage device is welded to the bottom plate of the upper connecting box; one end of the upper unit bottom beam is welded to a side plate of the upper connecting box; a bottom of the upper sleeve is welded to the bottom plate of the upper connecting box; a top end of the lower anchorage device is welded to the top plate of the lower connecting box, and the bottom surface of the lower anchorage device is welded to a position limiting nut on the lower anchorage device; an upper end of the lower sleeve is welded to the top plate of the lower connecting box, and a lower end of the lower sleeve is welded to a bottom plate of the lower anchorage device; a top end of the lower unit column is welded to a bottom surface of the lower connecting box, and one end of the lower unit ceiling beam is welded to a side plate of the lower connecting box.

16. The high-rise modular steel structure building node applicable for the region of high seismic intensity according to claim 1, wherein the upper unit column is welded to the top plate of the upper connecting box, and a bottom end of the upper anchorage device is welded to the bottom plate of the upper connecting box; one end of the upper unit bottom beam is welded to a side plate of the upper connecting box; a bottom of the upper sleeve is welded to the bottom plate of the upper connecting box; a top end of the lower anchorage device is welded to the top plate of the lower connecting box, and the bottom surface of the lower anchorage device is welded to a position limiting nut on the lower anchorage device; an upper end of the lower sleeve is welded to the top plate of the lower connecting box, and a lower end of the lower sleeve is welded to a bottom plate of the lower anchorage device; a top end of the lower unit column is welded to a bottom surface of the lower connecting box, and one end of the lower unit ceiling beam is welded to a side plate of the lower connecting box.

17. A construction method for the high-rise modular steel structure building node applicable for the region of high seismic intensity according to claim 1, wherein the construction method comprises following steps of:

(1) reserving the positioning holes in the top plate and the bottom plate of the upper connecting box, in the connecting plate, in the top plate of the bottom connecting box, in the upper anchorage device, and in the lower anchorage device in a factory;

(2) in the factory, fixedly connecting the lower anchorage device to the lower sleeve, reserving the injection pipe hole, mounting the injection pipe, and providing the lower position limiting nut at a lower part of the lower anchorage device, fixedly connecting the lower position limiting nut to the lower anchorage device; fixedly connecting the upper sleeve to the bottom plate of the upper connecting box;

(3) in the factory, fixedly connecting the lower anchorage device to a bottom surface of the top plate of the lower connecting box, and fixedly connecting the upper anchorage device to the top surface of the upper connecting box;

(4) in the factory, connecting the bottom plate, the top plate, a front plate, and a rear plate of the upper connecting box to a left side plate and a right side plate of the upper connecting box by welding and connecting the bottom plate, the top plate, a front plate, and a rear plate of the lower connecting box to a left side plate and a right side plate of the lower connecting box by welding, such that the upper connecting box and the lower connecting box are formed respectively;

(5) After hoisting of the lower unit is completed at a construction site, placing the connecting plate reserved with the positioning hole above the top plate of the lower connecting box, and aligning a center of the positioning hole in the connecting plate with a center of the positioning hole in the top plate of the lower connecting box vertically;

(6) Passing the pull rod shear lock through the connecting plate, the top plate of the lower connecting box, the lower sleeve, and the lower anchorage device from top to bottom sequentially, and threadedly and fixedly connecting the pull rod shear lock with the lower position limiting nut located on the bottom surface of the lower anchorage device;

(7) hoisting and placing the upper unit onto the lower unit, and at this time, the pull rod shear lock passing through the bottom plate of the upper connecting box and the top plate of the upper connecting box sequentially;

(8) suspending hoisting when a top end of the pull rod shear lock passes through the top plate of the upper connecting box and does not pass through the upper anchorage device, and starting hoisting again after screwing on the upper position limiting nut located at the lower part of the upper anchorage device;

(9) tightening the upper position limiting nut located at an upper part of the upper anchorage device and applying pretightening force through the upper position limiting nut after the top end of the pull rod shear lock passes through the upper anchorage device and the hoisting operation is completed;

(10) After applying pretightening force, injecting the epoxy resin adhesive, through the injection pipe, into the mounting clearance around the shear control section of the pull rod shear lock through the injection pipe, such that installation of the high-rise modular steel structure building node is completed.

18. The construction method for the high-rise modular steel structure building node applicable for the region of high seismic intensity according to claim 17, wherein injection pipe holes are provided on the lower sleeve, the lower anchorage device, and a side plate of the lower connecting box such that the injection pipe is arranged, and the epoxy resin adhesive is injected, through the injection pipe, into the mounting clearances provided between the shear control section of the pull rod shear lock and the upper sleeve, between the shear control section of the pull rod shear lock and the positioning hole in the bottom plate of the upper connecting box, between the shear control section of the pull rod shear lock and the positioning hole in the connecting plate, between the shear control section of the pull rod shear lock and the positioning hole in the top plate of the lower connecting box, and between the shear control section of the pull rod shear lock and the lower sleeve.

19. A construction method for the high-rise modular steel structure building node applicable for the region of high seismic intensity according to claim 2, wherein the construction method comprises following steps of:

(1) reserving the positioning holes in the top plate and the bottom plate of the upper connecting box, in the connecting plate, in the top plate of the bottom connecting box, in the upper anchorage device, and in the lower anchorage device in a factory;

(2) in the factory, fixedly connecting the lower anchorage device to the lower sleeve, reserving the injection pipe hole, mounting the injection pipe, and providing the lower position limiting nut at a lower part of the lower anchorage device, fixedly connecting the lower position limiting nut to the lower anchorage device; fixedly connecting the upper sleeve to the bottom plate of the upper connecting box;

(3) in the factory, fixedly connecting the lower anchorage device to a bottom surface of the top plate of the lower connecting box, and fixedly connecting the upper anchorage device to the top surface of the upper connecting box;

(4) in the factory, connecting the bottom plate, the top plate, a front plate, and a rear plate of the upper connecting box to a left side plate and a right side plate of the upper connecting box by welding and connecting the bottom plate, the top plate, a front plate, and a rear plate of the lower connecting box to a left side plate and a right side plate of the lower connecting box by welding, such that the upper connecting box and the lower connecting box are formed respectively;

(5) After hoisting of the lower unit is completed at a construction site, placing the connecting plate reserved with the positioning hole above the top plate of the lower connecting box, and aligning a center of the positioning hole in the connecting plate with a center of the positioning hole in the top plate of the lower connecting box vertically;

(6) Passing the pull rod shear lock through the connecting plate, the top plate of the lower connecting box, the lower sleeve, and the lower anchorage device from top to bottom sequentially, and threadedly and fixedly connecting the pull rod shear lock with the lower position limiting nut located on the bottom surface of the lower anchorage device;

(7) hoisting and placing the upper unit onto the lower unit, and at this time, the pull rod shear lock passing through the bottom plate of the upper connecting box and the top plate of the upper connecting box sequentially;

(8) suspending hoisting when a top end of the pull rod shear lock passes through the top plate of the upper connecting box and does not pass through the upper anchorage device, and starting hoisting again after screwing on the upper position limiting nut located at the lower part of the upper anchorage device;

(9) tightening the upper position limiting nut located at an upper part of the upper anchorage device and applying pretightening force through the upper position limiting nut after the top end of the pull rod shear lock passes through the upper anchorage device and the hoisting operation is completed;

(10) After applying pretightening force, injecting the epoxy resin adhesive, through the injection pipe, into the mounting clearance around the shear control section of the pull rod shear lock through the injection pipe, such that installation of the high-rise modular steel structure building node is completed.

20. A construction method for the high-rise modular steel structure building node applicable for the region of high seismic intensity according to claim 4, wherein the construction method comprises following steps of:

(1) reserving the positioning holes in the top plate and the bottom plate of the upper connecting box, in the connecting plate, in the top plate of the bottom connecting box, in the upper anchorage device, and in the lower anchorage device in a factory;

(2) in the factory, fixedly connecting the lower anchorage device to the lower sleeve, reserving the injection pipe hole, mounting the injection pipe, and providing the lower position limiting nut at a lower part of the lower anchorage device, fixedly connecting the lower position limiting nut to the lower anchorage device; fixedly connecting the upper sleeve to the bottom plate of the upper connecting box;

(3) in the factory, fixedly connecting the lower anchorage device to a bottom surface of the top plate of the lower connecting box, and fixedly connecting the upper anchorage device to the top surface of the upper connecting box;

(4) in the factory, connecting the bottom plate, the top plate, a front plate, and a rear plate of the upper connecting box to a left side plate and a right side plate of the upper connecting box by welding and connecting the bottom plate, the top plate, a front plate, and a rear plate of the lower connecting box to a left side plate and a right side plate of the lower connecting box by welding, such that the upper connecting box and the lower connecting box are formed respectively;

(5) After hoisting of the lower unit is completed at a construction site, placing the connecting plate reserved with the positioning hole above the top plate of the lower connecting box, and aligning a center of the positioning hole in the connecting plate with a center of the positioning hole in the top plate of the lower connecting box vertically;

(6) Passing the pull rod shear lock through the connecting plate, the top plate of the lower connecting box, the lower sleeve, and the lower anchorage device from top to bottom sequentially, and threadedly and fixedly connecting the pull rod shear lock with the lower position limiting nut located on the bottom surface of the lower anchorage device;

(7) hoisting and placing the upper unit onto the lower unit, and at this time, the pull rod shear lock passing through the bottom plate of the upper connecting box and the top plate of the upper connecting box sequentially;

(8) suspending hoisting when a top end of the pull rod shear lock passes through the top plate of the upper connecting box and does not pass through the upper anchorage device, and starting hoisting again after screwing on the upper position limiting nut located at the lower part of the upper anchorage device;

(9) tightening the upper position limiting nut located at an upper part of the upper anchorage device and applying pretightening force through the upper position limiting nut after the top end of the pull rod shear lock passes through the upper anchorage device and the hoisting operation is completed;

(10) After applying pretightening force, injecting the epoxy resin adhesive, through the injection pipe, into the mounting clearance around the shear control section of the pull rod shear lock through the injection pipe, such that installation of the high-rise modular steel structure building node is completed.

* * * * *